United States Patent [19]

Vehling et al.

[11] 3,948,127

[45] Apr. 6, 1976

[54] APPARATUS FOR SEVERING TOWS OF FIBROUS MATERIAL

[75] Inventors: Ernst Vehling, Bordesholm; Rolf Paulsen, Neumunster, both of Germany

[73] Assignee: Neumunstersche Maschinen-und Apparatebau GmbH, Neumunster, Germany

[22] Filed: Aug. 30, 1974

[21] Appl. No.: 502,001

[30] Foreign Application Priority Data

Aug. 30, 1973 Germany ..... 2343690

[52] U.S. Cl. ..... 83/100; 83/346; 83/511; 83/512; 83/913

[51] Int. Cl.[2] ..... D01G 1/00; D01G 1/04

[58] Field of Search ..... 83/100, 346, 347, 349, 83/343, 913, 510–512

[56] References Cited

UNITED STATES PATENTS

| | | | |
|---|---|---|---|
| 2,607,418 | 8/1952 | Hebeler | 83/913 X |
| 2,642,135 | 6/1953 | Regalia | 83/913 X |
| 3,334,533 | 8/1967 | Davis, Jr. | 83/913 X |
| 3,768,355 | 10/1973 | Farmer et al. | 83/913 X |

*Primary Examiner*—J. M. Meister
*Attorney, Agent, or Firm*—Michael J. Striker

[57] ABSTRACT

Apparatus for severing a tow of crimped textile fibers has an outer cage and an inner cage. The inner cage has an annulus of idler rollers extending in parallelism with the common axis of the cages, and the outer cage has an annulus of elongated knives whose cutting edges spacedly surround and face the rollers. A tow of textile fibers is fed axially into the inner cage and is guided radially outwardly by an eyelet in the inner cage to enter a ring-shaped compartment between the knives and the rollers. A motor drives the inner cage or the outer cage to thereby convolute the tow in the compartment whereby the driven cage adds convolutions in the region immediately adjacent to the rollers and such convolutions cause the outer convolutions to expand toward and to be severed by the cutting edges. The severed fibers are withdrawn by a suction chamber which surrounds the outer cage. An endless belt can be trained over the rollers and over several pulleys in the interior of the inner cage so that a looped portion of the belt spacedly surrounds the eyelet and a cylindrical portion of the belt surrounds the rollers and supports the innermost convolution of the tow in the compartment.

18 Claims, 3 Drawing Figures

APPARATUS FOR SEVERING TOWS OF FIBROUS MATERIAL

BACKGROUND OF THE INVENTION

The present invention relates to apparatus for severing fibrous material, especially for severing cables or tows consisting of textile filaments.

Many branches of textile industry utilize relatively short fragments of filamentary material which are obtained by severing a continuous tow or cable of filaments at regular intervals. The length of fragments of filamentary material depends on their intended use and normally varies between a few millimeters and two hundred millimeters. As a rule, the tow which is to be severed to yield fragments of filamentary material having a predetermined length consists of crimped fibers. At the present time, the requirements for fragments of crimped filaments greatly exceed the demand for uncrimped fibers. The severing operation is preferably carried out while the filaments are under tension so that the crimp disappears during severing; this insures that the filaments can be subdivided into fragments of identical length. The crimp reappears as soon as the filaments are severed, i.e., immediately upon termination of the tensional stress. In order to insure an economical operation, the tow of filamentary material must be fed to the severing apparatus at an elevated speed, preferably in excess of 300 meters per minute.

In a presently known severing apparatus, the tow is caused to pass between two rubber-coated rollers having radial slots for knives which move radially outwardly when in register with the nip of the rollers to thereby sever the filaments of the tow. Such apparatus operate satisfactorily, even when the tow is fed at a high speed. However, the wear on their parts is high and the mechanism for moving the knives radially of the rollers is complex and prone to malfunction.

It is also known to utilize severing apparatus wherein the tow is convoluted onto a rotary drum having rigid radially outwardly extending knives. The cutting edges are located at the radially outermost ends of the knives. An elastic roller cooperates with the drum to urge the tow against the cutting edges of successive knives whereby the tow yields fragments in response to severing of the innermost convolution or winding of the tow. The fragments are evacuated by suction through the interior of the rotating drum. The path along which the fragments of severed filaments are evacuated includes the spaces between neighboring knives of the drum; the width of such spaces decreases in a direction toward the axis of the drum so that the fragments are likely to accumulate into bunches which clog the spaces and are unable to enter the interior of the drum. The tendency of fragments to form accumulations or bunches of interlaced fibrous particles is further enhanced by the fact that the filaments of the tow are normally twisted. Another drawback of the just described apparatus is that the stretch of filaments which form convolutions around the periphery of the drum decreases in a direction toward the axis of the drum, i.e., the tensional stress upon the filaments which are being severed by the cutting edges of the knives is considerably less than the tensional stress upon the filaments which form the outermost convolution of the tow around the periphery of the drum. This reduces the reproducibility of the severing operation because at least some of the filaments exhibit a pronounced crimp at the time they are being severed by the knives.

SUMMARY OF THE INVENTION

An object of the invention is to provide a novel and improved apparatus for severing filaments, especially for severing a continuous tow or cable of textile filaments, with a high degree of reproducibility, while the tow is transported at a high speed, and without clogging of the path or paths along which the severed material is transported away from the severing station.

Another object of the invention is to provide a severing apparatus wherein the wear upon moving parts and severing elements is negligible or low, wherein the fragments of severed filamentary material are evacuated and collected in a novel and improved way, and wherein each filament can be subjected to a predetermined tensional stress during severing to yield fragments of predictable length.

A further object of the invention is to provide a severing apparatus which reduces the likelihood of bunching of fragments of severed filaments at or during travel away from the severing station.

Still another object of the invention is to provide a novel set of knives for use in the improved severing apparatus.

An additional object of the invention is to provide novel and improved means for shaping a continuous tow of filamentary textile or other material prior to and during severing to yield fragments of selected and reproducible length.

The invention is embodied is an apparatus for severing a tow or cable of filamentary material, especially a tow of textile fibers. The apparatus comprises a first cage which preferably resembles a wheel and includes convoluting means forming a first annulus and preferably including a plurality of parallel rotary convoluting members (e.g., slender rollers), a passage provided in the convoluting means, a second cage including a plurality of knives forming a second annulus surrounding the convoluting means and defining therewith a substantially ring-shaped compartment which communicates with the interior of the first cage by way of the passage in the convoluting means, cutting edges provided on the knives and facing the convoluting means, means for feeding a tow of filamentary material (e.g., a tow of crimped textile fibers) substantially axially of and into the interior of the first cage, an eyelet or analogous means for guiding the tow in the first cage substantially radially outwardly so that the tow extends through the passage of the convoluting means and into the ring-shaped compartment, and means for rotating at least one of the cages with respect to the other cage about the axis of the first annulus to thereby wind the tow onto the convoluting means. The tow forms in the compartment a package of convolutions to which convolutions are being added from within in response to rotation of the one cage, and the outermost convolutions of the package are displaced (expanded) radially outwardly to move into the range of and to be severed by the cutting edges of the knives.

In accordance with a presently preferred embodiment, the severing apparatus further comprises an endless flexible element (e.g., an endless band or belt) one portion of which is trained around the rollers of the convoluting means and another portion of which extends into the interior of the first cage to form therein a loop which is trained over additional rollers of the first cage and spacedly surrounds the eyelet. Those parts of the band or belt which connect its aforementioned portions are trained over two rollers of the convolution means which flank the aforementioned passage. The severed filaments are preferably withdrawn radially outwardly through the spaces between the knives by a suction chamber a portion of which surrounds the second cage.

The novel features which are considered as characteristic of the invention are set forth in particular in the appended claims. The improved severing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
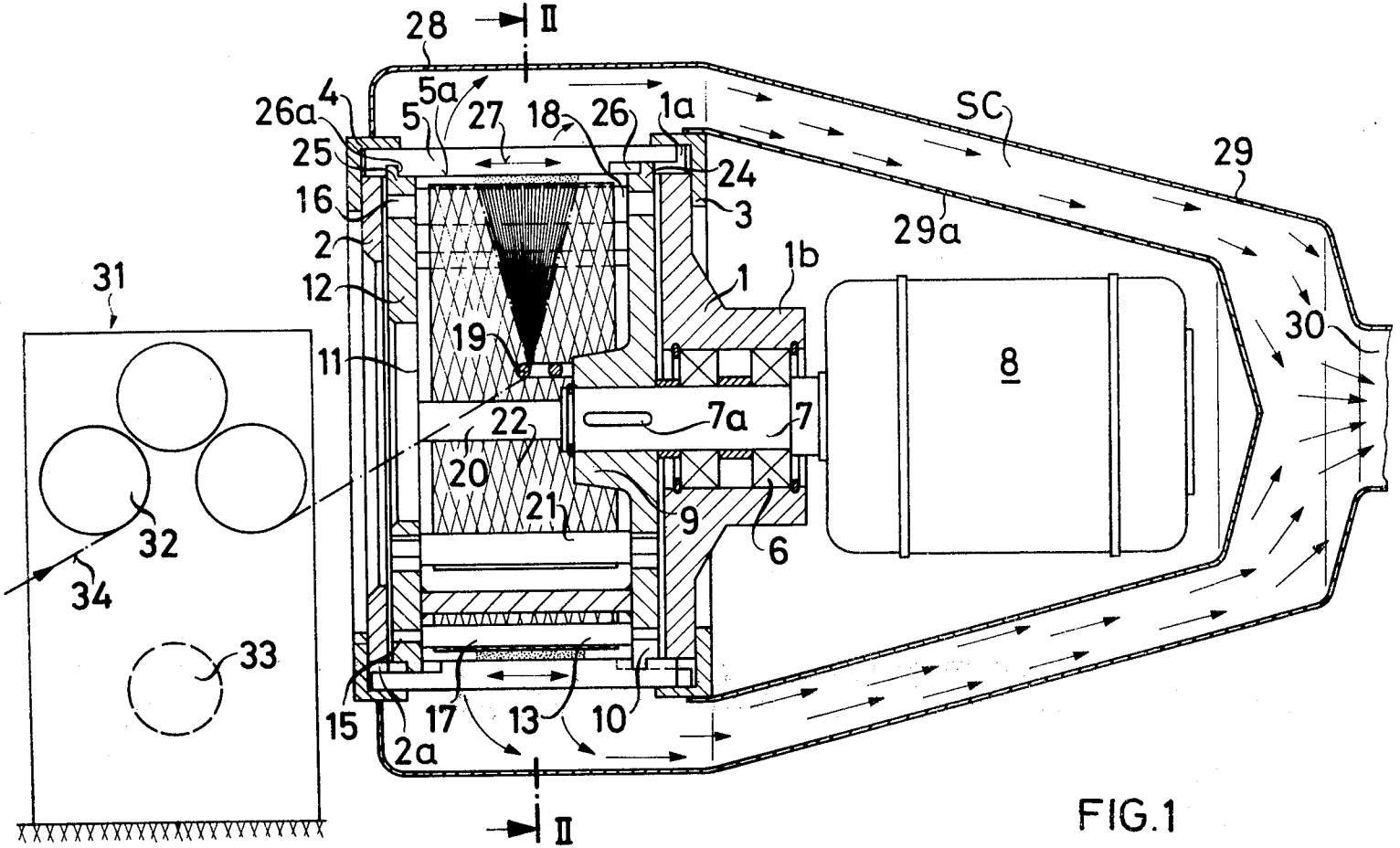
FIG. 1 is a longitudinal sectional view of a severing apparatus which embodies one form of the invention.
Figure 2:
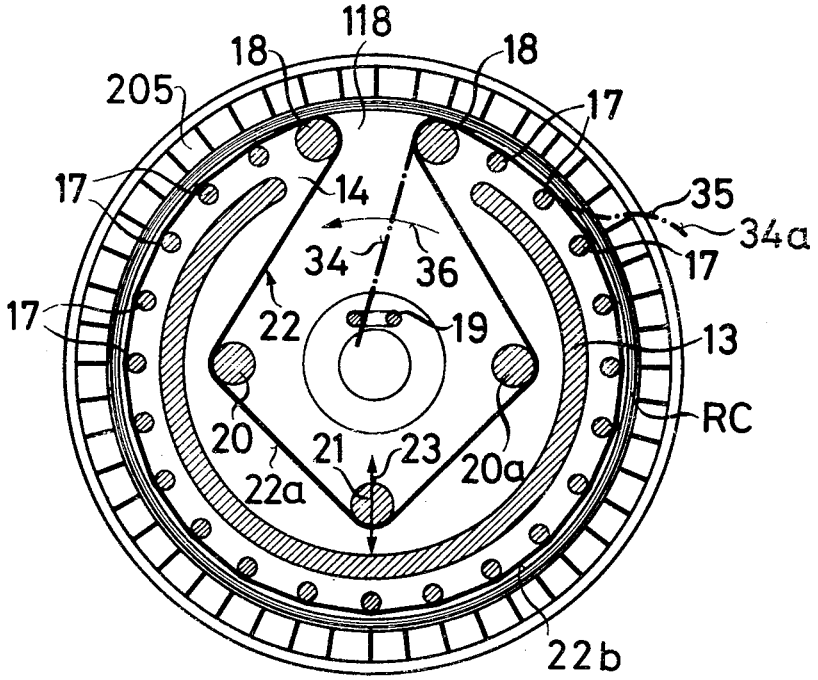
FIG. 2 is a sectional view as seen in the direction of arrows from the line II—II of FIG. 1.

The severing apparatus of FIGS. 1 and 2 comprises a stationary outer hollow body or cage having a frame including a round disk-shaped rear wall 1, a flat ring-shapped front wall 2 which is spaced apart from and parallel to the rear wall 1, and two ring-shaped retainers 3, 4 each having an L-shaped cross-sectional outline. The frame 1–4 of the outer cage supports an annulus of elongated knives 5 which are parallel to the common axis of the walls 1 and 2. The retainer 3 has a radially inwardly extending portion which overlies the marginal portion of the rear side of the rear wall 1 and a cylindrical portion which surrounds the rear end portions of the knives 5. The retainer 4 has a radially inwarding extending portion which overlies the marginal portion of the front side of the front wall 1 and a cylindrical portion which surrounds the front end portions of the knives 5. The retainer 3, 4 are respectively secured to the walls 3, 4 by screws, bolts or analogous fasteners, not shown, so as to afford convenient access to the knives 5 for the purposes of inspection and replacement. The front and rear end portions of the knives 5 respectively extend into peripheral recesses or notches 2a, 1a of the walls 2 and 1. The distance between each pair of neighboring knives 5 is preferably identical (See FIG. 2) and each knife resembles a flat blade having an inwardly facing cutting edge 5a. The aforementioned cylindrical portions of the retainers 3, 4 respectively hold the rear and front end portions of the knives 5 against ejection from the recesses 1a, 2a under the pressure of the fibrous material to be severed. The retainer 3 is further secured to the inner wall 29a of a substantially annular suction chamber SC the outer wall 28 of which surrounds the outer cage and is connected to the front retainer 4. The outer wall 28 has a rearwardly tapering extension 29 which spacedly surrounds the inner wall 29a and has an outlet 30 connected to the intake end of a fan or another suitable suction generating device, not shown. The inner wall 29a of the suction chamber SC is connected to the extension 29 of the outer wall 28 by one or more radially extending ribs or webs, not shown.

It will be noted that the outer cage including the frame 1–4 and knives 5 resembles a wheel with outlet openings or spaces 205 between the knives 5. The severed filaments of a cable or two 34 leave the outer cage via spaces 205 and are withdrawn from the suction chamber SC via outlet 30. As stated before, the cutting edges 5a of the knives 5 face inwardly, i.e., toward the axis of the hollow outer cage.

The prime mover for an inner hollow body or cage or rotor 11 of the severing apparatus is an electric motor 8 which is mounted in the interior of the inner wall **29*a* of the suction chamber SC and has an output shaft 7 extending into the interior of the outer cage. The inner cage or rotor 11 has a substantially disk-shaped round rear wall 10 having a hub 9 which is keyed to the output shaft 7, as at 7*a*. The rear wall 10 of the inner cage 11 is adjacent to the front side of the rear wall 1 of the frame of the outer cage. The hub 1b of the stationary rear wall 1 receives two anti-friction ball or roller bearings 6 for the output shaft 7.**

The inner cage 11 is dimensioned to fill the major part of the interior of the outer cage and further comprises a flat ring-shaped front wall 12 which is adjacent to the inner side of the front wall 2 of the frame of the outer cage. The walls 10, 12 of the inner cage 11 are held apart by an arcuate distancing member 13 (see also FIG. 2) which is a cylinder rigid with the walls 10, 12 and having a relatively wide axially extending aperature or slot 14. The distancing member 13 is surrounded by a convoluting means including an annulus of slender parallel idler rollers 17, 18. The end portions of the shafts 15 of the rollers 17 are journalled in the walls 10, 12 and these rollers are outwardly adjacent to the distancing member 13 (See FIG. 2). The diameters of the idler rollers 18 exceed the diameters of the rollers 17, and the end portions of the shafts shafts 16 of rollers 18 are also mounted in the walls 10, 12 of the inner cage 11. FIG. 2 shows that the inner cage 11 comprises two rollers 18 and that these rollers are outwardly adjacent to the slot 14 of the distancing member 13. The axes of the rollers 18 are nearer to the axis of the inner cage 11 than the axes of the rollers 17 so that the outermost portions of rollers 17 and 18 touch a circle having its center on the common axis of the two cages.

Each of the twenty-one rollers 17 resembles a slender solid cylinder and the diameter of each roller 17 may equal or approximate the radius of a roller 18. The distances between the axes of neighboring rollers 17 are preferably identical, and the distance between the axis of a roller 18 and the axis of the nearest roller 17 preferably equals the distance between the axes of two neighboring rollers 17. However, the distance between the axes of the rollers 18 substantially exceeds (and may be a multiple of) the distance between the axes of two neighboring rollers 17. The rollers 18 define a relatively wide passage 118.

The hub 9 of the rear wall 10 of the inner cage 11 supports a tow guiding means 19 in the form of an eyelet through which the tow 34 extends and is thereupon spread apart (see FIG. 1) and passes substantially radially outwardly toward and through that portion (passage 118) of the slot 14 which is located between the larger-diameter idler rollers 18. The inner cage 11 further contains three additional rollers or pulleys **20, 20*a*, 21 whose diameters equal or approximate the diameters of the idler rollers 18 and whose end portions are rotatably mounted in the walls 10, 12. The pulleys 20, 20***a* and 21 serve to guide an endless flexible element 22, e.g., a band or belt. As shown in FIG. 2, the belt 22 is trained over the outer portions of the pulleys 20, 20*a*, 21, thereupon extends between and is trained over the rollers 18, and surrounds the rollers 17. At least one of the pulleys 20, 20*a*, 21 is movable sideways, i.e., radially of the inner cage 11, and is preferably biased by one or more springs (not shown) so as to tension the belt 22 whereby the latter bears against the outermost portions of the rollers 17. It is assumed that the roller 21 is reciprocable radially of the inner cage 11 (see the double-headed arrow 23 in FIG. 2) and is biased radially outwardly by one or more helical or other suitable springs to thereby tension the belt 22 and to maintain it in contact with the pulleys 20, 20*a* and all of the rollers 18, 17. FIG. 2 shows that the rollers 18 and pulleys 20, 20*a*, 21 are disposed at the corners of an irregular pentagon which spacedly surrounds the axis of the inner cage 11 and the eyelet 19. FIG. 2 further shows that the belt 22 includes a portion or loop 22*a* which surrounds the pulleys 20, 20*a*, 21 and a substantially cylindrical portion 22*b* which surrounds the rollers 17 and terminates at the rollers 18. The cylindrical portion 22*b* of the belt 22 is located radially inwardly of and is spaced apart from the cutting edges 5*a*, i.e., the knives 5 and the cylindrical portion 22*a* of the band 22 define a substantially ring-shaped compartment RC which receives convolutions of the tow 34 when the severing apparatus is in use.

The peripheral surfaces of the rear and front walls 10, 12 of the inner cage 11 are respectively provided with circumferentially complete reciprocating devices or projections 24, 25 which constitute wipers and serve to shift the knives 5 axially back and forth in response to rotation of the shaft 7. The projection 24 extends into alternating camming notches 26*a* and axially parallel cutouts 26 of successive knives 5, as considered in the circumferential direction of the inner cage 11. Thus, each knife 5 has a notch 26*a* at one end and a cutout 26 at the other end, but the 26*a* of a preceding knife 5 is located in front of the cutout 26 of the next following knife. Each of the projections 24 and 25 has an undulate shape and its developed view may resemble a complete wave or a small number of waves. The width of the notches 26*a* is such that the projections 24, 25 are received therein with a minimal play but the length of each cutout 26 substantially exceeds the width of the projection 24 and 25, as considered in the axial direction of the inner cage 11. When the cage 11 is driven by the motor 8, the undulate projections 24, 25 cause the knives 5 to move back and forth as indicated by the double-headed arrow 27. The projection 24 reciprocates the first, third, etc. knives 5, and the projection 25 reciprocates the second, fourth, etc. knives. The waveforms of the undulate projections 24, 25 are offset relative to each other by one-half of a wavelength, as considered in the circumferential direction of the inner cage 11, whereby the neighboring knives 5 of the outer cage are caused to move in opposite directions.

The reference character 31 denotes a schematically shown tow feeding unit which comprises three rolls 32 driven by a prime mover 33, e.g., an electric motor or a transmission. The motor 8 and/or 33 is preferably an infinitely variable-speed motor so that the peripheral speed of the inner cage 11 exceeds the speed of transport of the tow 34 by the rolls 32. This insures that the crimp of fibrous filamentary material of the tow 34 is reduced during travel along a path extending from the rightmost roll 32 and substantially axially of the inner cage 11 toward the eyelet 19. Furthermore, by utilizing at least on infinitely variable-speed prime mover, the attendants can insure that the filaments which move into the range of cutting edges 5a in the compartment RC are subjected to optimum tensional stresses whereby the tensioning can take place during transport of the tow from the feeding unit 31 into the compartment RC and/or during radially outward movement of convolutions in the compartment.

The operation is as follows:

When the motors 8 and 33 are at a standstill, the leader 34*a* (see FIG. 2) of the tow 34 is trained over the rolls 32 of the feeding unit 31 and is introduced substantially axially of the inner cage 11 through the central openings of the front walls 2, 12, threaded through the eyelet 19 and passage 118 between the rollers 18, trained around the right-hand roller 18 (as viewed in FIG. 2), caused to overlie the adjacent part of the cylindrical portion 22*b* of the belt 22, caused to pass through a space 205 between two neighboring knives 5, and attached to a stationary protuberance 35 of the outer cage or suction chamber SC. The motors 33 and 8 are thereupon started whereby the shaft 7 drives the inner cage 11 in a counterclockwise direction, as viewed in FIG. 2 (see the arrow 36). When the inner cage 11 completes a first revolution, the tow 34 forms a complete winding or convolution extending around the belt portion 22*b*. In response to the next (second) revolution of the inner cage 11, the tow 34 forms a second convolution which is located inside the first convolution, i.e., between the first or outer convolution and the portion 22*b* of the belt 22. Thus, the inner cage 11 causes the tow 34 to form a package of windings or convolutions whereby the freshly formed convolutions are surrounded by the previously formed convolutions. The length of the outer convolutions in the compartment RC increases in response to the formation of fresh (inner) convolutions whereby the filamentary material of the tow 34 in the compartment RC undergoes a tensioning or stretching action. At first, the convolutions of the tow 34 in the compartment RC do not rotate with the inner cage 11 because the leader 34*a* is attached to the stationary protuberance 35. Thus, the belt 22 travels relative to the rollers 17, 18, and pulleys 20, 20*a*, 21 which orbit about the axis of the rotating inner cage 11 and which simultaneously rotate about their own axes. It can be said that the belt portion 22*b* is at a standstill, i.e., it does not slip with respect to the convolutions in the compartment RC.

When the combined thickness of the convolutions in the compartment RC (as considered in the radial direction of the inner cage 11) increases to such an extent that the outermost convolution begins to bear against the cutting edges 5*a* of the knives 5 or the outer cage (the knives reciprocate in parallelism with the axis of the outer cage but do not orbit about the axis of the inner cage), the filaments of the outermost convolution are severed by the cutting edges 5*a* and the resulting fragments of filaments are drawn into the suction chamber SC to be evacuated via outlet 30. Once the outermost convolution of the tow 34 in the compartment RC reaches the knives 5, the convolutions are held against rotation by the cutting edges 5*a* in spite of the fact that the leader 34*a* is separated from the next-following portion of the tow 34 as soon as the knives 5 sever the outermost convolution.

The inner cage 11 continues to draw successive increments of the tow 34 into the compartment RC so that the thickness of the package of filamentary material in this compartment grows and the cutting edges 5*a* sever the second outermost, third outermost, etc. convolutions to form a continuous supply of severed filaments which pass through the suction chamber SC and on to the next processing station, e.g., to a baling press. Each revolution of the inner cage 11 further results in a twisting of the tow 34 through 360 degrees. This is desirable because the filaments of the tow are held together on their way through the eyelet 19. It has been found that, when the severing apparatus of FIGS. 1 and 2 is in use, all of the knives 5 continuously engage the filamentary material in the compartment RC as soon as the combined thickness of convolutions in this compartment reaches a value which corresponds to the distance between the outer side of the belt portion 22*b* and the cutting edges 5*a*. The evacuation of severed filaments from the outer cage is facilitated by the fact that the width of the spaces 105 between neighboring knives 5 increases radially outwardly (see FIG. 2). The suction chamber SC constitutes but one form of means for removing severed filamentary material from the spaces 105. Furthermore, the chamber SC may surround only a portion of the motor 8, or this motor can be replaced with a variable-speed transmission.

The belt 22 constitutes an optional but highly desirable feature of the severing apparatus. In the absence of such belt, portions of severed or broken filaments in the compartment RC are likely to be coiled onto the rollers 17 and/or 18.

An advantage of the severing apparatus of FIG. 1 (wherein the outer cage is stationary) is that the mass of rotating parts is relatively small, especially since the convolutions of the package of filamentary material in the compartment RC need not rotate about the axis of the inner cage 11.

As stated before, the knives 5 are accessible for inspection, removal or replacement upon detachment of the retainer 3 and/or 4 from the respective wall 1 and/or 2 of the outer cage. This is desirable because the attendants can readily change the length of fragmentized filaments by the simple expedient of removing each second knife 5, by removing each second and third knife, and so forth. Moreover, the attendants can distribute the knives in such a way that the apparatus will turn out simultaneously short and long fragments of filamentary material. The reciprocability of knives 5 during severing the tow 34 is desirable for a number of reasons. Thus, such knives are more likely to produce clean cuts and they are also more likely to subdivide the tow into short or extremely short fragments of identical length. Furthermore, and since the neighboring knives of the outer cage preferably move in opposite directions, the combined mass of knives which move lengthwise in a direction to the right, as viewed in FIG. 1 is balanced by the combined mass of knives which move in a direction to the left.

Figure 3:
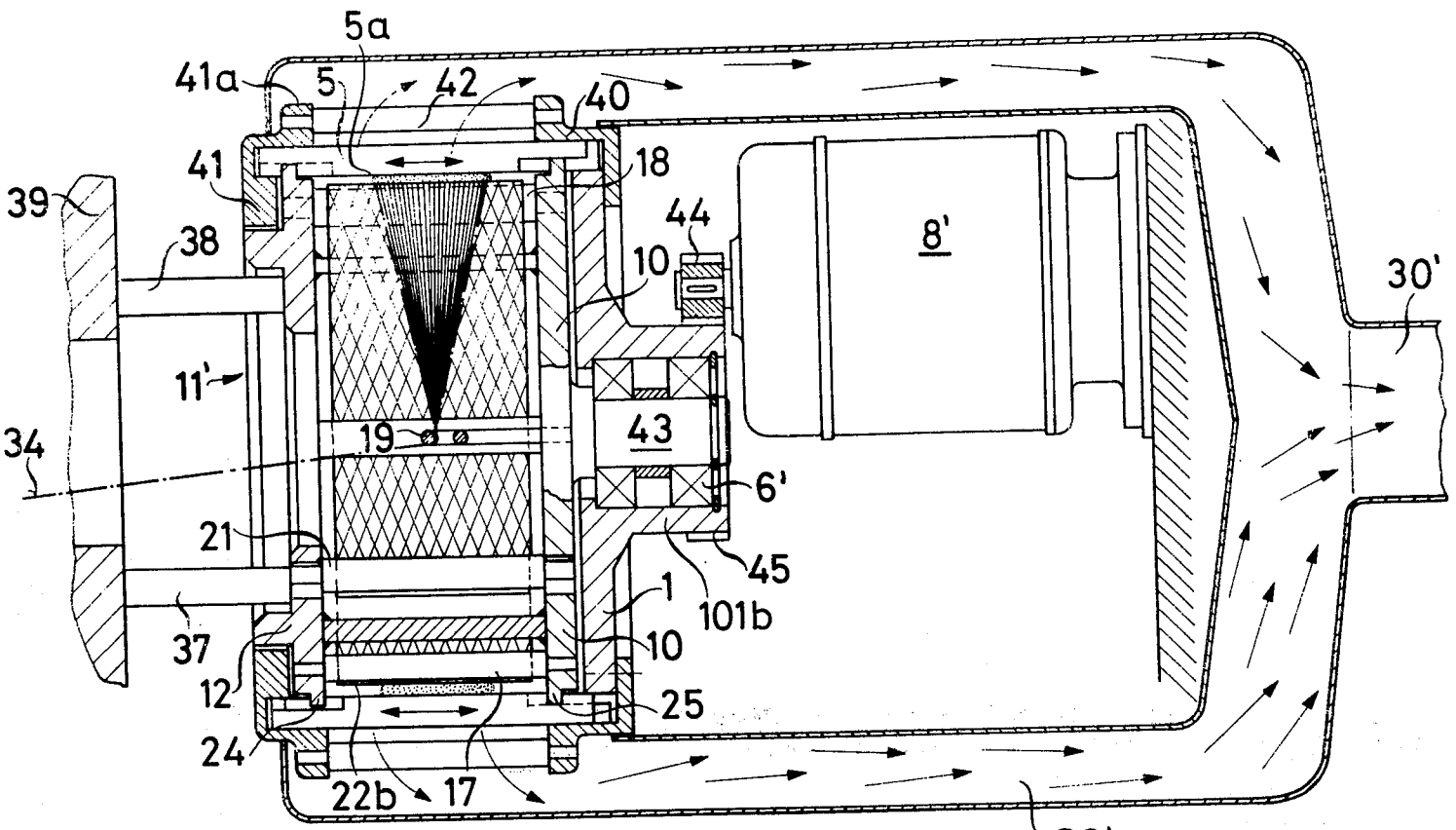
FIG. 3 is a longitudinal sectional view of a modified severing apparatus.

FIG. 3 shows a portion of a second severing apparatus wherein the walls 10, 12, rollers 17, 18, and pulleys 20, 20*a*, 21 (not all of these pulleys are shown in FIG. 3) constitute a wheel-shaped stationary inner cage 11 and the parts 1 and 5 constitute components of a rotary outer cage. The tow feeding unit has a stationary support 39 which is connected to the front wall 12 by two or more coupling members 37, 38. The front wall 41 of the rotary outer cage is rigid or integral with a front retainer 41*a*, and the rear wall 1 is rigid with a detachable rear retainer 40. The retainers 40, 41*a* are connected to each other by a cylindrical distancing member 42 having a plurality of preferably elongated slots through which comminuted filaments can pass on their way into a modified suction chamber SC′ having an outlet 30′. The hub 101*b* of the rear wall 1 of the outer cage is rotatable on two antifriction bearings 6′ surrounding a stub 43 which is rigid with the rear wall 10 of the inner cage 11′. The hub 101*b* is formed with or rigidly connected to a gear 45 meshing with a gear 44 on the output shaft of a prime mover 8′. The manner in which the knives 5 cooperate with the projections 24, 25 of the stationary walls 10, 12 of the inner cage 11′ is preferably identical with or similar to that described in connection with FIGS. 1 and 2. The leader of a tow 34 is introduced through the feeding unit (support 39) and is caused to pass through the eyelet 19 and thereupon into the compartment between the belt 22 and the knives 5. When the motor 8′ is started, the outer cage begins to draw the tow 34 into the compartment surrounding the belt portion 22*b*. The tow forms a first winding or convolution which directly surrounds the belt portion 22*b*, thereupon a second convolution within the first convolution, and so forth, the same as described in connection with FIGS. 1 and 2. The main difference is that the convolutions in the compartment rotate with the parts of the outer cage so that the outermost convolution is severed by the cutting edges 5*a* while it rotates at the speed of orbital movement of the knives 5 and while the knives move back and forth under the action of stationary undulate projections 24, 25. The stretching or expansion of convolutions progresses as the convolutions approach the cutting edges 5*a*. The first convolution or convolutions rotate with the outer cage because the leader of the tow 34 is again attached (e.g., by forming a knot) to a protuberance or the like on the outer cage. Once the convolutions reach the knives 5, they continue to rotate with the outer cage in spite of the fact that the leader is severed from the next-following portion of the tow 34 as soon as the cutting edges 5*a* sever the outermost convolution. The portion 22*b* of the belt rotates with the outer cage whereby the rollers 17, 18 of the inner cage 11′ rotate about their respective axes. In the apparatus of FIG. 3, the evacuation of severed filaments through the spaces between the knives 5 and through the slots of the distancing member 42 into the adjacent foremost portion of the suction chamber SC′ is assisted by centrifugal force. Thus, the fact that the outer cage rotates relative to the inner cage contributes to more convenient evacuation of severed filaments into the suction chamber SC′.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. Apparatus for severing a tow of filamentary material, comprising a first cage including convoluting means forming a first annulus and having a passage, said convolvting means comprising a plurality of idler rollers parallel to the axis of said first annulus and each rotatable about its own axis; a second cage including a plurality of knives forming a second annulus surrounding said first annulus and defining therewith a substantially ring-shaped compartment in communication with the interior of said first cage by way of said passage, said knives having cutting edges facing said convoluting means; means for feeding the tow substantially axially of and into said first cage; means for guiding said tow in said first cage outwardly so that the tow extends through said passage and into said compartment; and means for rotating at least one of said cages with respect to the other of said cages about the axis of said first annulus to thereby wind the tow onto said convoluting means whereby the tow forms in said compartment a package of convolutions to which convolutions are being added from within in response to rotation of said one cage and the outermost convolutions of which are displaced radially outwardly into the range of and are severed by said cutting edges.

2. Apparatus as defined in claim 1, wherein said rollers include first and second rollers which flank said passage.

3. Apparatus as defined in claim 1, wherein said one cage is said first cage.

4. Apparatus as defined in claim 1, wherein said one cage is said second cage.

5. Apparatus as defined in claim 1, wherein said second cage has a plurality of spaces alternating with said knives and communicating with said compartment, and further comprising means for evacuating severed filaments from said compartment by way of said spaces.

6. Apparatus as defined in claim 5, wherein said evacuating means comprises at least one suction chamber.

7. Apparatus as defined in claim 1, wherein said second cage comprises a frame for said knives and said frame includes means for removably retaining said knives in said frame.

8. Apparatus as defined in claim 1, wherein said knives are elongated and said cutting edges thereof are substantially parallel to said axis.

9. Apparatus as defined in claim 8, wherein said second cage further comprises a frame for said knives and at least some of said knives are reciprocable in said frame in parallelism with said axis, and further comprising means for reciprocating said reciprocable knives in response to rotation of said one cage.

10. Apparatus as defined in claim 9, wherein said reciprocating means comprises devices for moving at least one of said reciprocable knives in one direction while moving the other reciprocable knives in the opposite direction, and vice versa.

11. Apparatus as defined in claim 10, wherein all of said knives are reciprocable in said frame and said devices are arranged to move the neighboring knives of said second annulus in opposite directions.

12. Apparatus as defined in claim 1, wherein said feeding means comprises a first prime mover and said rotating means comprises a second prime mover at least one of said prime movers being a variable-speed prime mover so as to permit for changing the ratio of the speed at which the tow is fed into said first cage to the speed at which said one case is rotated with respect to said other cage.

13. Apparatus as defined in claim 12, wherein at least one of said prime movers comprises an infinitely variable-speed motor.

14. Apparatus for severing a tow of filamentary material, comprising a first cage including convoluting means forming a first annulus and a passage, said convoluting means comprising a plurality of rollers which are parallel to the axis of said first annulus and which include first rollers and second rollers flanking said passage; a second cage including a plurality of knives forming a second annulus surrounding said first annulus and defining therewith a substantially ring-shaped compartment in communication with the interior of said first cage by way of said passage, said knives having cutting edges facing said convoluting means; means for feeding said tow substantially axially into said first cage; means for guiding said tow in said first cage outwardly so that the tow extends through said passage and into said compartment; pulley means spacedly surrounding said means for guiding said tow; an endless flexible element having a first portion disposed in said compartment and surrounding said plurality of rollers and a second portion trained over said pulley means; and means for rotating at least one of said cages with respect to the other of said cages about the axis of said first annulus to thereby wind the tow onto said convoluting means whereby the tow forms in said compartment a package of convolutions to which convolutions are added from within in response to rotation of said one cage and the outermost convolutions of which are displaced radially outwardly into the range of and are severed by said cutting edges.

15. Apparatus as defined in claim 14, wherein said second portion of said endless flexible element is a loop which extends into said first cage through said passage between said first and second rollers.

16. Apparatus as defined in claim 14, further comprising means for tensioning said flexible element so that said first portion of said flexible element bears against said rollers.

17. Apparatus as defined in claim 16, wherein said pulley means comprises a plurality of discrete pulleys rotatable about axes which are parallel to the axis of said first annulus.

18. Apparatus as defined in claim 17, wherein said biasing means includes one of said discrete pulleys and means for urging said one pulley sideways against said flexible element.

* * * * *